US009141047B2

(12) United States Patent
Uchitani et al.

(10) Patent No.: US 9,141,047 B2
(45) Date of Patent: Sep. 22, 2015

(54) FIXING DEVICE AND IMAGE FORMING APPARATUS

(71) Applicants: Takeshi Uchitani, Kanagawa (JP); Masahiko Satoh, Tokyo (JP); Masaaki Yoshikawa, Tokyo (JP); Kenji Ishii, Kanagawa (JP); Tadashi Ogawa, Tokyo (JP); Takahiro Imada, Kanagawa (JP); Hiromasa Takagi, Tokyo (JP); Hiroshi Yoshinaga, Chiba (JP); Arinobu Yoshiura, Kanagawa (JP); Teppei Kawata, Kanagawa (JP); Takamasa Hase, Shizuoka (JP); Hajime Gotoh, Kanagawa (JP); Takuya Seshita, Kanagawa (JP); Kazuya Saito, Kanagawa (JP); Toshihiko Shimokawa, Kanagawa (JP); Kensuke Yamaji, Kanagawa (JP); Shuutaroh Yuasa, Kanagawa (JP); Akira Suzuki, Tokyo (JP); Shinichi Namekata, Kanagawa (JP); Ryota Yamashina, Kanagawa (JP); Yasunori Ishigaya, Kanagawa (JP)

(72) Inventors: Takeshi Uchitani, Kanagawa (JP); Masahiko Satoh, Tokyo (JP); Masaaki Yoshikawa, Tokyo (JP); Kenji Ishii, Kanagawa (JP); Tadashi Ogawa, Tokyo (JP); Takahiro Imada, Kanagawa (JP);

(Continued)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/693,550

(22) Filed: Apr. 22, 2015

(65) Prior Publication Data

US 2015/0227095 A1 Aug. 13, 2015

Related U.S. Application Data

(63) Continuation of application No. 13/763,047, filed on Feb. 8, 2013, now Pat. No. 9,042,761.

(30) Foreign Application Priority Data

Feb. 9, 2012 (JP) ..... 2012-026056
Dec. 20, 2012 (JP) ..... 2012-278001

(51) Int. Cl.
*G03G 15/20* (2006.01)

(52) U.S. Cl.
CPC ..... *G03G 15/2039* (2013.01)

(58) Field of Classification Search
CPC ..... G03G 15/2039; G03G 15/205; G03G 2215/2035
USPC ..... 399/33, 69, 70, 122, 320, 329
See application file for complete search history.

(56) References Cited

U.S. PATENT DOCUMENTS 5,832,332 A * 11/1998 Sugiura ..... 399/44
7,120,371 B2 10/2006 Fujimori (Continued)

FOREIGN PATENT DOCUMENTS

JP 2007-003992 1/2007
JP 2007-079040 3/2007

(Continued)

*Primary Examiner* — Francis Gray
(74) *Attorney, Agent, or Firm* — Oblon, McClelland, Maier & Neustadt, L.L.P.

(57) ABSTRACT

A fixing device capable of shifting to a sleep state includes a heat source; a rotatable fixing member that is partly heated by the heat source to heat an unfixed image carrying surface of a recording medium; a rotatable pressing member that is in pressure contact with the fixing member to form a nip portion between the pressing member and the fixing member; a rotation drive unit that directly or indirectly rotates the fixing member; a temperature detecting unit that detects a temperature of the fixing member; and a controller configured to prohibit the fixing device from shifting to the sleep state when the temperature of the fixing member in a region facing the heat source is equal to or more than a predetermined temperature $T_1$ at a point when a predetermined time period $t_1$ has elapsed from the stop of rotation drive of the rotation drive unit.

14 Claims, 9 Drawing Sheets

(72) Inventors: Hiromasa Takagi, Tokyo (JP); Hiroshi Yoshinaga, Chiba (JP); Arinobu Yoshiura, Kanagawa (JP); Teppei Kawata, Kanagawa (JP); Takamasa Hase, Shizuoka (JP); Hajime Gotoh, Kanagawa (JP); Takuya Seshita, Kanagawa (JP); Kazuya Saito, Kanagawa (JP); Toshihiko Shimokawa, Kanagawa (JP); Kensuke Yamaji, Kanagawa (JP); Shuutaroh Yuasa, Kanagawa (JP); Akira Suzuki, Tokyo (JP); Shinichi Namekata, Kanagawa (JP); Ryota Yamashina, Kanagawa (JP); Yasunori Ishigaya, Kanagawa (JP)

(56) References Cited

U.S. PATENT DOCUMENTS

| | | | | |
|---|---|---|---|---|
| 7,885,590 | B2 | 2/2011 | Seo et al. | |
| 2005/0271407 | A1* | 12/2005 | Fujimori | 399/70 |
| 2006/0029411 | A1 | 2/2006 | Ishii et al. | |
| 2006/0088326 | A1 | 4/2006 | Nakayama | |
| 2007/0059012 | A1 | 3/2007 | Tomine et al. | |
| 2007/0110467 | A1 | 5/2007 | Ohno et al. | |
| 2007/0212089 | A1 | 9/2007 | Seo et al. | |
| 2007/0280754 | A1 | 12/2007 | Ogawa et al. | |
| 2007/0292175 | A1 | 12/2007 | Shinshi | |
| 2008/0025772 | A1 | 1/2008 | Seo et al. | |
| 2008/0025773 | A1 | 1/2008 | Ito et al. | |
| 2008/0124147 | A1 | 5/2008 | Uehara et al. | |
| 2008/0219721 | A1 | 9/2008 | Ito et al. | |
| 2008/0226326 | A1 | 9/2008 | Seo et al. | |
| 2008/0232873 | A1 | 9/2008 | Ueno et al. | |
| 2008/0279577 | A1* | 11/2008 | Ito | 399/69 |
| 2009/0123201 | A1 | 5/2009 | Ehara et al. | |
| 2009/0148205 | A1 | 6/2009 | Seo et al. | |
| 2009/0202269 | A1 | 8/2009 | Tomine et al. | |
| 2009/0245865 | A1 | 10/2009 | Shinshi et al. | |
| 2009/0245897 | A1 | 10/2009 | Seo et al. | |
| 2009/0297197 | A1 | 12/2009 | Hase | |
| 2010/0061753 | A1 | 3/2010 | Hase | |
| 2010/0074667 | A1 | 3/2010 | Ehara et al. | |
| 2010/0092220 | A1 | 4/2010 | Hasegawa et al. | |
| 2010/0092221 | A1 | 4/2010 | Shinshi et al. | |
| 2010/0202809 | A1 | 8/2010 | Shinshi et al. | |
| 2010/0290822 | A1 | 11/2010 | Hasegawa et al. | |
| 2010/0303479 | A1 | 12/2010 | Itoh et al. | |
| 2010/0303521 | A1 | 12/2010 | Ogawa et al. | |
| 2011/0026988 | A1 | 2/2011 | Yoshikawa et al. | |
| 2011/0044706 | A1 | 2/2011 | Iwaya et al. | |
| 2011/0044734 | A1 | 2/2011 | Shimokawa et al. | |
| 2011/0052237 | A1 | 3/2011 | Yoshikawa et al. | |
| 2011/0052245 | A1 | 3/2011 | Shinshi et al. | |
| 2011/0052277 | A1 | 3/2011 | Ueno et al. | |
| 2011/0052282 | A1 | 3/2011 | Shinshi et al. | |
| 2011/0058862 | A1 | 3/2011 | Yamaguchi et al. | |
| 2011/0058863 | A1 | 3/2011 | Shinshi et al. | |
| 2011/0058864 | A1 | 3/2011 | Fujimoto et al. | |
| 2011/0058865 | A1 | 3/2011 | Tokuda et al. | |
| 2011/0058866 | A1 | 3/2011 | Ishii et al. | |
| 2011/0064437 | A1 | 3/2011 | Yamashina et al. | |
| 2011/0064443 | A1 | 3/2011 | Iwaya et al. | |
| 2011/0064450 | A1 | 3/2011 | Ishii et al. | |
| 2011/0064490 | A1 | 3/2011 | Imada et al. | |
| 2011/0064502 | A1 | 3/2011 | Hase et al. | |
| 2011/0076071 | A1 | 3/2011 | Yamaguchi et al. | |
| 2011/0085815 | A1 | 4/2011 | Kishi et al. | |
| 2011/0085832 | A1 | 4/2011 | Hasegawa et al. | |
| 2011/0091253 | A1 | 4/2011 | Seo et al. | |
| 2011/0116848 | A1 | 5/2011 | Yamaguchi et al. | |
| 2011/0129268 | A1 | 6/2011 | Ishii et al. | |
| 2011/0150518 | A1 | 6/2011 | Hase et al. | |
| 2011/0170917 | A1 | 7/2011 | Yoshikawa et al. | |
| 2011/0176821 | A1 | 7/2011 | Hase | |
| 2011/0176822 | A1 | 7/2011 | Ishii et al. | |
| 2011/0182634 | A1 | 7/2011 | Ishigaya et al. | |
| 2011/0182638 | A1 | 7/2011 | Ishii et al. | |
| 2011/0194870 | A1 | 8/2011 | Hase et al. | |
| 2011/0195358 | A1 | 8/2011 | Shinshi | |
| 2011/0200368 | A1 | 8/2011 | Yamaguchi et al. | |
| 2011/0200370 | A1 | 8/2011 | Ikebuchi et al. | |
| 2011/0206427 | A1 | 8/2011 | Iwaya et al. | |
| 2011/0211876 | A1 | 9/2011 | Iwaya et al. | |
| 2011/0217056 | A1 | 9/2011 | Yoshinaga et al. | |
| 2011/0217057 | A1 | 9/2011 | Yoshinaga et al. | |
| 2011/0217093 | A1 | 9/2011 | Tokuda et al. | |
| 2011/0217095 | A1 | 9/2011 | Ishii et al. | |
| 2011/0222875 | A1 | 9/2011 | Imada et al. | |
| 2011/0222876 | A1 | 9/2011 | Yuasa et al. | |
| 2011/0222888 | A1 | 9/2011 | Ikebuchi et al. | |
| 2011/0222929 | A1 | 9/2011 | Fujimoto et al. | |
| 2011/0222930 | A1 | 9/2011 | Fujimoto et al. | |
| 2011/0222931 | A1 | 9/2011 | Shinshi et al. | |
| 2011/0229162 | A1 | 9/2011 | Ogawa et al. | |
| 2011/0229178 | A1 | 9/2011 | Ogawa et al. | |
| 2011/0229181 | A1 | 9/2011 | Iwaya et al. | |
| 2011/0229200 | A1 | 9/2011 | Yamaguchi et al. | |
| 2011/0229225 | A1 | 9/2011 | Ishii et al. | |
| 2011/0229226 | A1 | 9/2011 | Tokuda et al. | |
| 2011/0229227 | A1 | 9/2011 | Yoshikawa et al. | |
| 2011/0229228 | A1 | 9/2011 | Yoshikawa et al. | |
| 2011/0229236 | A1 | 9/2011 | Ehara et al. | |
| 2011/0274453 | A1 | 11/2011 | Shimokawa et al. | |
| 2011/0286758 | A1 | 11/2011 | Yoshinaga | |
| 2011/0293309 | A1 | 12/2011 | Hase | |
| 2011/0311284 | A1 | 12/2011 | Seo et al. | |
| 2012/0045226 | A1 | 2/2012 | Hase et al. | |
| 2012/0051766 | A1 | 3/2012 | Ueno et al. | |
| 2012/0051774 | A1 | 3/2012 | Ikebuchi et al. | |
| 2012/0093531 | A1 | 4/2012 | Yuasa et al. | |
| 2012/0093551 | A1 | 4/2012 | Ogawa et al. | |
| 2012/0107005 | A1 | 5/2012 | Hase et al. | |
| 2012/0114345 | A1 | 5/2012 | Fujimoto et al. | |
| 2012/0114354 | A1 | 5/2012 | Saito et al. | |
| 2012/0121303 | A1 | 5/2012 | Takagi et al. | |
| 2012/0121304 | A1 | 5/2012 | Tokuda et al. | |
| 2012/0121305 | A1 | 5/2012 | Yoshikawa et al. | |
| 2012/0141155 | A1 | 6/2012 | Suzumi | |
| 2012/0148303 | A1 | 6/2012 | Yamaguchi et al. | |
| 2012/0155935 | A1 | 6/2012 | Yoshikawa et al. | |
| 2012/0155936 | A1 | 6/2012 | Yamaguchi et al. | |
| 2012/0177388 | A1 | 7/2012 | Imada et al. | |
| 2012/0177393 | A1 | 7/2012 | Ikebuchi et al. | |
| 2012/0177420 | A1 | 7/2012 | Shimokawa et al. | |
| 2012/0177423 | A1 | 7/2012 | Imada et al. | |
| 2012/0177424 | A1 | 7/2012 | Saito et al. | |
| 2012/0207523 | A1 | 8/2012 | Ueno et al. | |
| 2012/0219312 | A1 | 8/2012 | Yuasa et al. | |
| 2012/0224878 | A1 | 9/2012 | Ikebuchi et al. | |
| 2012/0237273 | A1 | 9/2012 | Yoshinaga et al. | |
| 2013/0011149 | A1* | 1/2013 | Ogasawara et al. | 399/43 |
| 2013/0045032 | A1 | 2/2013 | Shimokawa et al. | |
| 2013/0136479 | A1 | 5/2013 | Yuasa et al. | |
| 2013/0195493 | A1 | 8/2013 | Hase et al. | |
| 2013/0209119 | A1 | 8/2013 | Yuasa et al. | |
| 2013/0209124 | A1 | 8/2013 | Saito et al. | |
| 2013/0209125 | A1 | 8/2013 | Uchitani et al. | |

FOREIGN PATENT DOCUMENTS

| | | |
|---|---|---|
| JP | 2007-334205 | 12/2007 |
| JP | 2008-129517 | 6/2008 |
| JP | 2009-265173 | 11/2009 |
| JP | 2010-032625 | 2/2010 |
| JP | 4742165 | 5/2011 |
| JP | 4875385 | 12/2011 |

* cited by examiner

FIXING DEVICE AND IMAGE FORMING APPARATUS

CROSS-REFERENCE TO RELATED APPLICATIONS

This application is a continuation application of U.S. application Ser. No. 13/763,047, filed Feb. 8, 2013, and is based upon and claims priority to Japanese Patent Application No. 2012-026056 filed Feb. 9, 2012 and Japanese Patent Application No. 2012-278001 filed Dec. 20, 2012, and the entire contents of each of the above are incorporated herein by reference.

BACKGROUND OF THE INVENTION

1. Field of the Invention

The invention relates to a fixing device for fixing an image on a recording medium and an image forming apparatus including the fixing device.

2. Description of the Related Art

In an image forming apparatus such as a copying machine, a printer, a facsimile or an MFP having a function of these devices, and the like, a copied matter and a recorded matter can be obtained by heating and fixing an unfixed image transferred onto a recording medium such as a sheet and carried thereby.

In the fixing process, a developer, in particular, toner included in an unfixed image is melted and softened and penetrated into a recording medium by heating the unfixed image carried by the recording medium while sandwiching and conveying the recording medium by a fixing member and a pressing member, thereby the toner is fixed onto the recording medium.

Further, when the fixing member is heated to a predetermined temperature by a heat source, if a heat time up to the predetermined temperature is sufficiently short, a preheat process in a stand-by state can be omitted, and thus the amount of energy to be consumed can be greatly reduced. To achieve the energy saving effect, a member having a low heat capacity such as a thin roller, a belt, and the like, which is composed of a metal base member and an elastic rubber layer, is widely used as the fixing member. Further, rapid heating is performed by using a ceramic heater, an IH system having high heating efficiency, and the like as the heat source in addition to a halogen heater for heating the fixing member by radiant heat. Fixing devices having such configurations are disclosed in, for example, Japanese Patent Application Laid-open No. 2007-79040, Japanese Patent Application Laid-open No. 2010-32625, Japanese Patent Application Laid-open No. 2007-334205 and Japanese Patent Application Laid-open No. 2008-129517.

Among the fixing devices, in a fixing device configured to stretch a fixing belt by a fixing roller and a heating roller, a fixing device that is heated by an IH system, a fixing device for locally heating a fixing member by deviating the position where a built-in halogen heater is installed (partial heat system), a heat region that is heated by a heat source is positionally different from a fixing nip portion. Accordingly, even in a fixing member that is heated to a relatively high temperature in a heat region, during the image fixing operation, the temperature of the fixing member is not abnormally increased because a recording medium passing through a fixing nip portion takes heat from the fixing member. On the other hand, in a state that the rotation of the fixing member is stopped as in a case that the image fixing operation has been finished, even if a power supply to the heat source is stopped, the fixing member may be placed in an excessively increased temperature state by the excess heat (remaining heat) of the heat source (when sheets are continuously fed, a larger amount of heat is accumulated in a fixing device). Otherwise, even when excess heat in a heat source is not a so serious problem, the temperature of a surface of a fixing member may be increased by the excess heat of a reflector, a stay, and inside air whose temperature has been increased after the rotation of the fixing member is stopped. Further, when a heat region is away from a fixing nip portion, since the heat region is partially heated to a relatively high temperature to secure an amount of heat necessary to fixing at the time a belt portion heated in the heat region moves to the fixing nip portion, unless the heat is taken from the belt portion, the belt portion is damaged. In particular, in a fixing device having a fixing member whose thickness is further reduced to have a low heat capacity in order to reduce a warm-up time and energy to be consumed, there is a tendency that the problem is likely to occur in the fixing member.

In a partially heating fixing device, when an image fixing operation is finished and a fixing device is stopped, a pressing member takes the heat from a fixing member at the region of a fixing nip portion in contact with the pressing member. However, in the other region, in particular, in a region up to a fixing nip portion including the heat region, since heat remains stored because heat moves relatively slowly in a circumferential direction, the region is particularly thermally expanded. When a difference of a thermal expansion amount occurs between a high temperature region and a low temperature region because a temperature difference is large in a circumferential direction of the fixing member and the difference becomes excessively large, kink (plastic concaved crush formed in the fixing member) is generated in a central portion on a high temperature side. The generation of kink causes an abnormal image and further breaks the fixing member.

Ordinarily, since a temperature sensor is disposed in the vicinity of a heat source, when a temperature increase equal to or larger than a predetermined value occurs, the fixing member is thermally expanded in its entirety by being rotated or by taking heat from the fixing member in its entirety by a pressing member, thereby local expansion is prevented by making the temperature difference of the fixing member in a circumferential direction equal to or less than a prescribed value, and the generation of kink is avoided.

However, recently, since energy saving is emphasized, there are more cases that after an image forming operation is finished, a ready/stand-by state and a low power state are made very short and an operation is promptly shifted to a so-called sleep state in which power of the entire of an image forming apparatus is stopped, and then a power supply is resumed to the entire of the image forming apparatus when a signal is input from the outside or an operation panel. Further, there is also an image forming apparatus of a type that is provided with a sleep mode shift button and can be forcibly shifted to a sleep mode by a user. Note that a state called "off mode" in a copying machine is the same state as the "sleep mode", and the following explanation will be made using an expression "sleep".

In the sleep state, since only restart power is consumed, the power consumption of various devices can be reduced. However, after the operation is shifted to the sleep state as described above, an excessive temperature increase cannot be prevented because a temperature sensor cannot detect a temperature and a fixing member cannot be rotated. In particular, when sheets of paper are continuously fed and a larger amount of heat is accumulated in a fixing device, a serious problem of overshoot occurs.

Therefore, there is a need for a fixing device and an image forming apparatus capable of suppressing kink from being generated, to execute a shift to sleep state when it is possible to enter to a sleep state instantly after the completion of an image forming operation, and to achieve energy saving.

SUMMARY OF THE INVENTION

According to an embodiment, there is provided a fixing device capable of shifting to a sleep state. The fixing device includes a heat source; a rotatable fixing member that is partly heated by the heat source to heat an unfixed image carrying surface of a recording medium; a rotatable pressing member that is in pressure contact with the fixing member to form a nip portion between the pressing member and the fixing member; a rotation drive unit that directly or indirectly rotates the fixing member; a temperature detecting unit that detects a temperature of the fixing member; and a controller configured to prohibit the fixing device from shifting to the sleep state when the temperature of the fixing member in a region facing the heat source is equal to or more than a predetermined temperature $T_1$ at a point when a predetermined time period $t_1$ has elapsed from the stop of rotation drive of the rotation drive unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
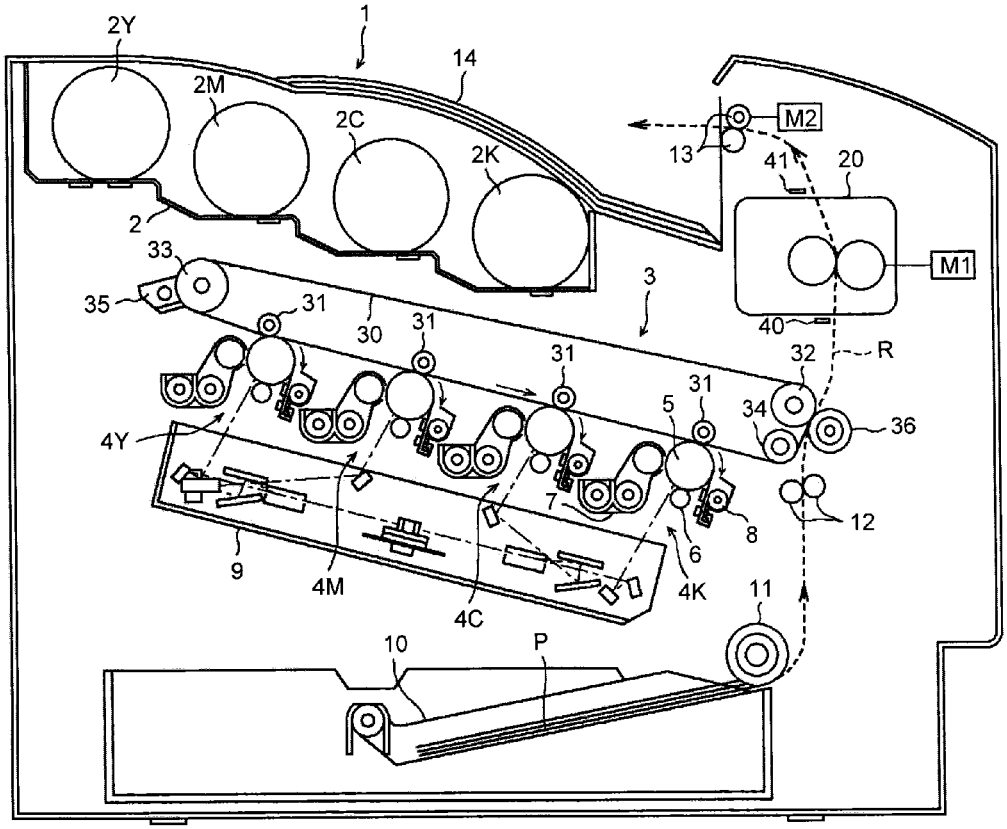
FIG. 1 is schematic configuration view illustrating an embodiment of an image forming apparatus according to the invention.

An embodiment of the invention will be explained below based on drawings. Note that, in the respective drawings for explaining the embodiment of the invention, configuration elements such as members, configuration parts, and the like having the same function or shape are denoted by the same reference numeral as long as they can be discriminated to thereby more simplify an explanation.

First, an overall configuration and an operation of an image forming apparatus according to an embodiment of the invention will be explained referring to FIG. 1.

An image forming apparatus 1 is a tandem color laser printer and four image forming units 4Y, 4M, 4C, 4K are disposed to the center of an apparatus main body thereof. The respective image forming units 4Y, 4M, 4C, 4K have the same configuration except that they accommodate developers of different colors of yellow (Y), magenta (M), cyan (C), black (K) corresponding to the color dissolving components of a color image.

To describe in detail, each of the image forming units 4Y, 4M, 4C, 4K has a drum-shaped photosensitive element 5 as a latent image carrier, a charging device 6 for charging a surface of the photosensitive element 5, a developing unit 7 for supplying toner to the surface of the photosensitive element 5, a cleaning device 8 for cleaning the surface of the photosensitive element 5, and the like. Note that, in FIG. 1, the photosensitive element 5, the charging device 6, the developing unit 7, and the cleaning device 8 of only the black image forming unit 4K are denoted by the respective reference numerals, and the reference numerals are omitted in the other image forming units 4Y, 4M, 4C.

An exposing device 9 for exposing the surface of the photosensitive element 5 is disposed below the respective image forming units 4Y, 4M, 4C, 4K. The exposure device 9 has a light source, a polygon mirror, an f-θ lens, a reflecting mirror, and the like and is configured to emit a laser beam to the respective surfaces of the photosensitive elements 5 based on an image data.

A transfer device 3 is disposed above the respective image forming units 4Y, 4M, 4C, 4K. The transfer device 3 includes an intermediate transfer belt 30 as a transfer body, four primary transfer rollers 31 as a primary transfer unit, a secondary transfer roller 36 as a secondary transfer unit, a secondary transfer backup roller 32, a cleaning backup roller 33, a tension roller 34, and a belt cleaning device 35.

The intermediate transfer belt 30 is an endless belt and stretched by the secondary transfer backup roller 32, the cleaning backup roller 33, and the tension roller 34. Here, the intermediate transfer belt 30 is caused to circularly travel (rotated) in a direction shown by an arrow in the drawing by that the secondary transfer backup roller 32 is driven in rotation.

The four primary transfer rollers 31 form primary transfer nips by sandwiching the intermediate transfer belt 30 between them and the respective photosensitive elements 5. Further, a not illustrated power supply is connected to the respective primary transfer rollers 31 so that a predetermined direct current voltage (DC) and/or an alternating current voltage (AC) is applied to the respective primary transfer rollers 31.

The secondary transfer roller 36 forms a secondary transfer nip by sandwiching the intermediate transfer belt 30 between it and the secondary transfer backup roller 32. Further, likewise the primary transfer rollers 31, a not illustrated power supply is connected also to the secondary transfer roller 36 so that a predetermined direct current voltage (DC) and/or an alternating current voltage (AC) is applied to the secondary transfer roller 36.

The belt cleaning device 35 has a cleaning brush and a cleaning blade disposed so as to be abutted to the intermediate transfer belt 30. A not illustrated waste toner transfer hose extending from the belt cleaning device 35 is connected to an inlet of a not illustrated waste toner accommodation unit.

A bottle accommodation unit 2 is disposed to an upper portion of a printer main body, and four toner bottles 2Y, 2M, 2C, 2K each accommodating replenishing toner are detachably mounted in the bottle accommodation unit 2. Not illustrated replenish paths are disposed between the respective toner bottles 2Y, 2M, 2C, 2K and the respective developing units 7 so that toners are replenished from the respective toner bottles 2Y, 2M, 2C, 2K to the respective developing units 7 via the replenish paths.

In contrast, a paper feed tray 10 in which sheets P as recording mediums are accommodated, a paper feeding roller 11 for carrying out the sheets P from the paper feed tray 10, and the like are disposed to a lower portion of the printer main body. Here, the recording medium conceptually includes a thick paper, a postal card, an envelope, a thin paper, a coated paper (coat paper, art paper, and the like) a tracing paper, an OHP sheet, and the like in addition to a plain paper. Further, although not illustrated, a manual paper feed mechanism may be disposed.

A conveying path R for causing a sheet P to pass through the secondary transfer nip from the paper feed tray 10 and discharging the sheet P to the outside of the apparatus is disposed in the printer main body. In the conveying path R, timing rollers 12 called a pair of registration rollers as a conveying unit for conveying the sheet P to the secondary transfer nip are disposed upstream of the secondary transfer roller 36 in a sheet conveying direction.

Further, a fixing device 20 for fixing an unfixed image transferred onto the sheet P is disposed downstream of the secondary transfer roller 36 in the sheet conveying direction. Further, a pair of discharging rollers 13 for discharging the sheet to the outside of the apparatus is disposed downstream of the fixing device 20 in the sheet conveying direction of the conveying path R. Then, a fixing motor M1 for driving the fixing device 20 and a discharging motor M2 for driving the discharging roller 13 are configured so as to be able to be driven independently from each other. Further, a discharging tray 14 for stocking the sheets discharged to the outside of the apparatus is disposed on an upper surface portion of the printer main body.

Subsequently, a basic operation of the printer according to the embodiment will be explained. When an image forming operation is started, the respective photosensitive elements 5 in the respective image forming units 4Y, 4M, 4C, 4K are driven in rotation clockwise in the drawing by a not illustrated driving device and the surfaces of the respective photosensitive elements 5 are uniformly charged to a predetermined polarity by the charging device 6. The charged surfaces of the respective photosensitive elements 5 are irradiated with a laser beam from the exposing device 9, and electrostatic latent images are formed on the surfaces of the respective photosensitive elements 5. At the time, image information exposed to each of the photosensitive elements 5 is monochromatic image information obtained by dissolving a desired full-color image to color information of yellow, magenta, cyan, and black. As described above, electrostatic latent images formed on the respective photosensitive elements 5 are visualized (made to visible images) as toner images by being supplied with toners by the respective developing units 7.

Further, when the image forming operation is started, the secondary transfer backup roller 32 is driven in rotation counterclockwise in the drawing causes the intermediate transfer belt 30 to travel circularly in the direction shown by the arrow in the drawing. Then, a constant voltage having a polarity opposite to a charged polarity of toner or a voltage controlled to a constant current is applied to the respective primary transfer rollers 31. With the operation, a transfer electric field is formed in the primary transfer nips between the respective primary transfer rollers 31 and the respective photosensitive elements 5.

Thereafter, when the toner images of the respective colors on the photosensitive elements 5 have reached the primary transfer nips as the respective photosensitive elements 5 rotate, the toner images on the respective photosensitive elements 5 are sequentially overlapped on and transferred onto the intermediate transfer belt 30 by a transfer electric field formed in the primary transfer nips. With the operation, a full-color toner image is carried on a surface of the intermediate transfer belt 30. Further, the toners on the respective photosensitive elements 5 that have not transferred onto the intermediate transfer belt 30 are removed by the cleaning device 8. Thereafter, a charge of the surfaces of the respective photosensitive elements 5 is neutralized by a not illustrated neutralization device and a surface potential is initialized.

In a lower portion of the image forming apparatus, the paper feeding roller 11 starts to be driven in rotation and the sheet P is fed from the paper feed tray 10 to the conveying path R. A timing of the sheet P having been fed to the conveying path R is measured by the registration rollers 12 and the sheet P is conveyed to the secondary transfer nip between the secondary transfer roller 36 and the secondary transfer backup roller 32. At the time, a transfer voltage having a polarity opposite to a toner charge polarity of the toner images on the intermediate transfer belt 30 is applied to the secondary transfer roller 36 to thereby form a transfer electric field to the secondary transfer nip.

Thereafter, when the toner images on the intermediate transfer belt 30 have reached the secondary transfer nip as the intermediate transfer belt 30 travels circularly, the toner images on the intermediate transfer belt 30 are collectively transferred onto the sheet P by the transfer electric field formed in the secondary transfer nip. Further, the toners that are not transferred onto the sheet P at the time and remain on the intermediate transfer belt 30 are removed by the belt cleaning device 35, and the removed toners are conveyed to the not illustrated waste toner accommodation unit and collected therein.

Thereafter, the sheet P is conveyed to the fixing device 20, and a toner image on the sheet P is fixed onto the sheet P by the fixing device 20. Then, the sheet P is discharged to the outside of the apparatus by the discharging roller 13 and stocked on the discharging tray 14.

The explanation described above is the image forming operation when a full-color image is formed on a sheet, it is also naturally possible to form a monochromatic image using any one of the four image forming units 4Y, 4M, 4C, 4K and to form an image having two or three colors using two or three image forming units.

Figure 2:
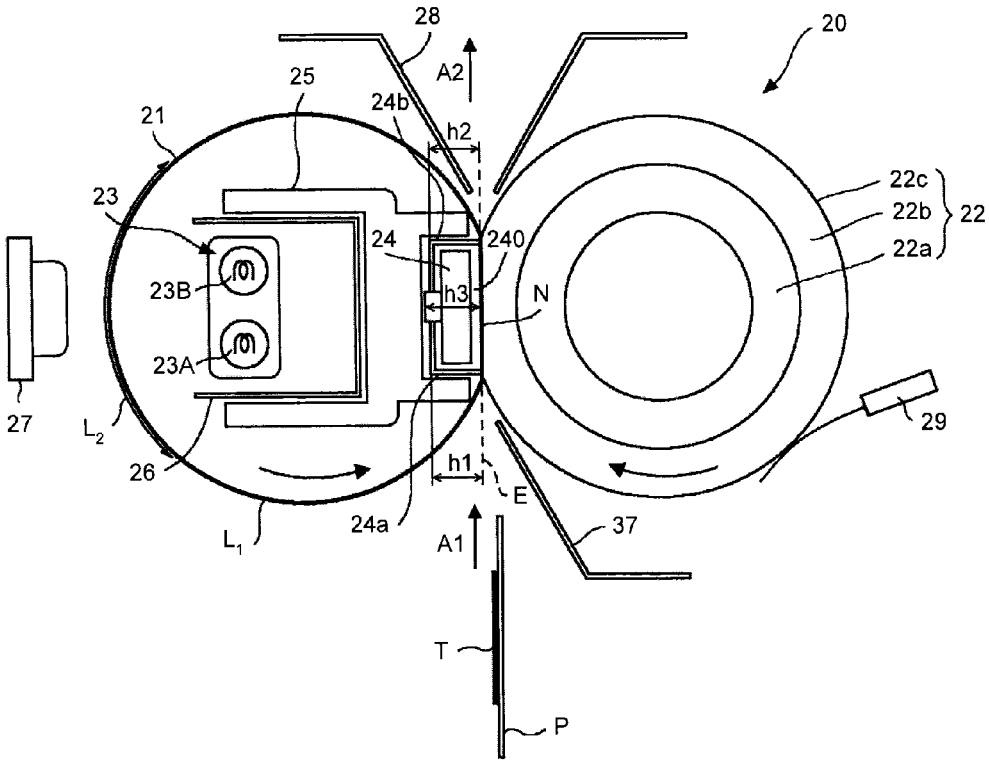
FIG. 2 is a schematic configuration view of a fixing device mounted on an image forming apparatus.

Next, a configuration of the fixing device 20 will be explained. As illustrated in FIG. 2, the fixing device 20 includes a fixing belt 21 as a rotatable fixing member, a pressing roller 22 as a pressing member rotatably disposed in confrontation with the fixing belt 21, a halogen heater 23 as a heat source for heating the fixing belt 21, a nip forming member 24 and a stay 25 as a support member disposed inside of the fixing belt 21, a reflection member 26 for reflecting light radiated from the halogen heater 23 to the fixing belt 21, a thermopile 27 as a temperature detecting unit for detecting the temperature of the fixing belt 21, a thermistor 29 as a temperature detecting unit for detecting the temperature of the pressing roller 22, a separation member 28 for separating a sheet from the fixing belt 21, a not illustrated pressing unit for pressurizing the pressing roller 22 to the fixing belt 21, and the like.

The fixing belt 21 is composed of a thin endless belt member (including also a film) having flexibility. To describe in detail, the fixing belt 21 is composed of an inner circumferential side base member formed of a material having a large thermal expansion such as nickel or SUS and an outer circumferential side separation layer formed of tetrafluoroethylene-perfluoroalkyl vinyl ether copolymer (PFA) or polytetrafluoroethylene (PTFE), and the like. Further, an elastic layer formed of a rubber material such as silicone rubber, foaming silicone rubber or fluorine rubber may be interposed between the base member and the separation layer.

The pressing roller 22 is composed of a cored bar 22*a*, an elastic layer 22*b* formed of foaming silicone rubber, silicone rubber, or fluorine rubber, and the like disposed on a surface of the cored bar 22*a*, and a separation layer 22*c* formed of PFA or PTFE and the like disposed on a surface of the elastic layer 22*b*. The pressing roller 22 is pressurized to the fixing belt 21 side by the not illustrated pressing unit and abutted to the nip forming member 24 via the fixing belt 21. At a position where the pressing roller 22 is in pressure contact with the fixing belt 21, a nip portion N having a predetermined width is formed by that the elastic layer 22*b* of the pressing roller 22 is crushed. Further, the pressing roller 22 is configured so as to be driven in rotation by a driving source such as a not illustrated motor and the like disposed to the printer main body. When the pressing roller 22 is driven in rotation, the driving force thereof is transmitted to the fixing belt 21 in the nip portion N, and the fixing belt 21 is rotated by the rotation of the pressing roller 22.

In the embodiment, although the pressing roller 22 is a hollow roller, it may be a solid roller. Further, a heat source such as a halogen heater and the like may be disposed inside of the pressing roller 22. When no elastic layer is employed, although a fixing property is improved because a heat capacity is reduced, there is a possibility that minute irregularities on a belt surface are transferred onto an image when unfixed toner is crushed and fixed and uneven glossiness may be generated to a solid portion of the image. To prevent the uneven glossiness, it is preferable to provide an elastic layer having a thickness of 100 μm or more. Since the provision of the elastic layer having the thickness of 100 μm or more can cause the minute irregularities to be absorbed by an elastic deformation of the elastic layer, the generation of the uneven glossiness can be avoided. Although the elastic layer 22*b* may be composed of a solid rubber, when no heat source is employed in the pressing roller 22, a sponge rubber may be used. The sponge rubber is more preferable because a heat insulation property is improved and the heat of the fixing belt 21 is less deprived. Further, the fixing member and the pressing member are not limited to the case in which they are in the pressure contact with each other and can be also configured such that they are simply in contact with each other without being pressed.

Figure 3:
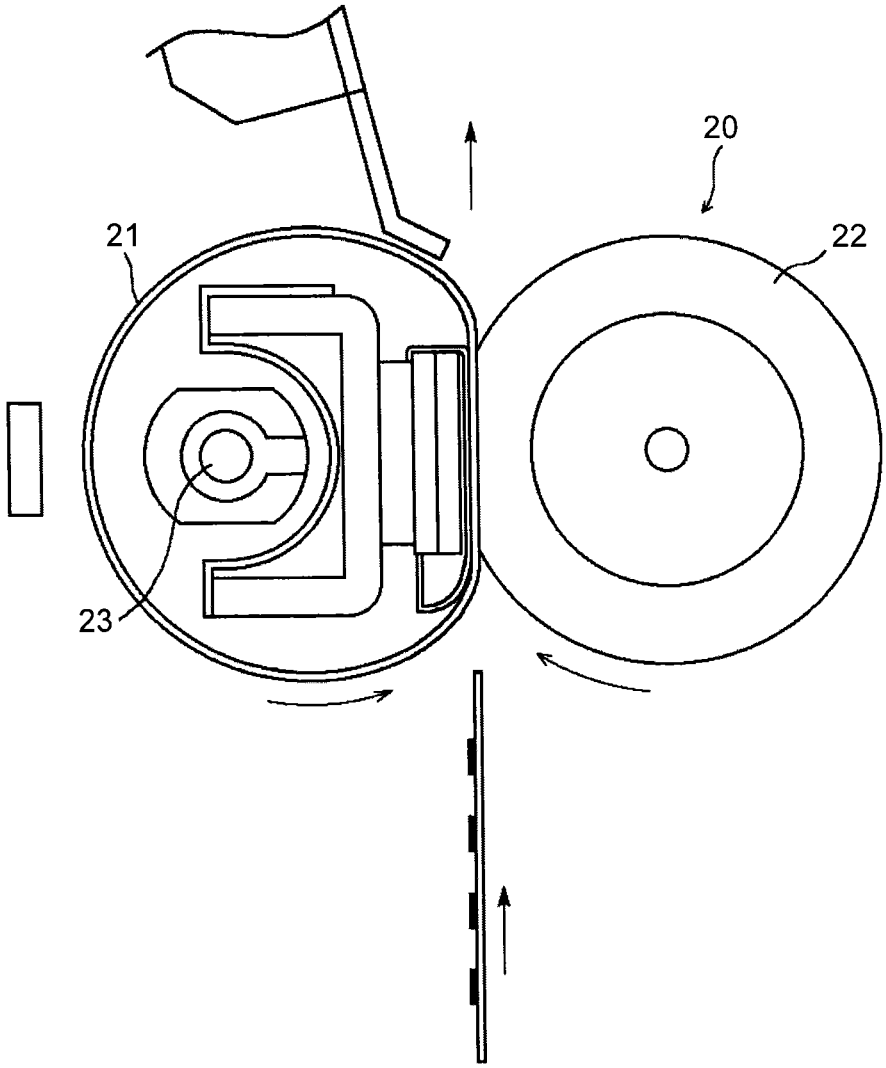
FIG. 3 is a schematic configuration view of a fixing device having only one halogen heater as a heat source.
Figure 4:
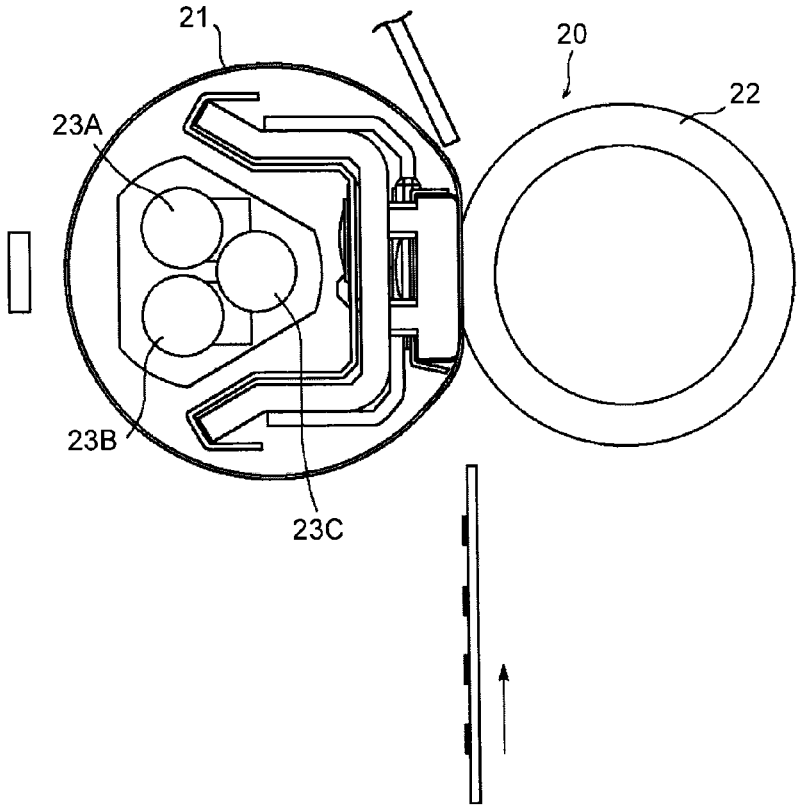
FIG. 4 is a schematic configuration view of a fixing device having three halogen heaters as a heat source.

In the embodiment, the halogen heater 23 is composed of two halogen heaters 23A (first halogen heater), 23B (second halogen heater), and both the end portions of the respective halogen heaters 23A, 23B are fixed to a side plate (not illustrated) of the fixing device 20. The respective halogen heaters 23A, 23B are configured to generate heat by being subjected to an output control by a power source unit disposed to the printer main body, and the output control is executed based on a result of detection of the surface temperature of the fixing belt 21 detected by the thermopile 27. The temperature (fixing temperature) of the fixing belt 21 can be set to a desired value by the output control of the heaters 23A, 23B. Note that the halogen heater may be a single heater capable of heating an entire width region through which a sheet can be passed as illustrated in FIG. 3, or may be three heaters 23A, 23B, and 23C or more capable of heating a width region through which a sheet can be passed by further dividing the width region as illustrated in FIG. 4, and the heat source for heating the fixing belt 21 may be a heating element other than the halogen heater, for example, a ceramic heater.

The nip forming member 24 is disposed in a long distance in an axis direction of the fixing belt 21 or in an axis direction of the pressing roller 22 and fixed and supported by the stay 25. With the configuration, a uniform nip width can be obtained in the axis direction of the pressing roller 22 by supporting the pressure from the pressing roller 22 and preventing a circumstance in which the nip forming member 24 is flexed. Note that it is preferable to form the stay 25 of a metal material having a high mechanical strength such as stainless steel and iron to satisfy a flexure preventing function of the nip forming member 24. Further, the section modulus of the stay 25 is increased by forming the stay 25 so as to have a laterally long cross-section extending in a pressing direction of the pressing roller 22, thereby it is possible to improve the mechanical strength of the stay 25.

Further, the nip forming member 24 is composed of a heat-resistant member having a heat resistant temperature of 200° C. or more. With the configuration, the deformation of the nip forming member 24 in a toner fixing temperature region caused by heat is prevented and the stable state of the nip portion N is secured, thereby the quality of an output image is stabilized. An ordinary heat-resistant resin such as polyethersulfone (PES), polyphenylene sulfide (PPS), a liquid crystal polymer (LCP), polyether nitrile (PEN), polyamide-imide (PAI), polyether ether ketone (PEEK), and the like can be used to the nip forming member 24. In the embodiment, the LCP is used.

Further, the nip forming member 24 has a low friction sheet 240 on a surface thereof. When the fixing belt 21 rotates, drive torque generated to the fixing belt 21 is reduced by causing the fixing belt 21 to slide on the low friction sheet 240, thereby a load due to friction force to the fixing belt 21 is reduced.

The reflection member 26 is disposed between the stay 25 and the halogen heater 23. The disposition of the reflection member 26 as described above causes light radiated from the halogen heater 23 to the stay 25 side to be reflected to the fixing belt 21. With the operation, an amount of light to be emitted to the fixing belt 21 can be increased so that the fixing belt 21 can be efficiently heated. Further, since radiant heat from the halogen heater 23 can be suppressed from being transmitted to the stay 25 and the like, energy can be saved.

Further, in the configuration of the fixing device 20 according to the embodiment, various devices are made to further improve an energy saving property, a first print output time, and the like.

Specifically, the halogen heater 23 is configured such that the fixing belt 21 can be directly heated by the halogen heater 23 at a position other than the nip portion N (direct heating method). In the embodiment, nothing is interposed between the halogen heater 23 and the fixing belt 21 on a left side portion in FIG. 2 so that the radiant heat from the halogen heater 23 is directly applied to the fixing belt 21 in the portion.

Further, to reduce the heat capacity of the fixing belt 21, the thickness and the diameter of the fixing belt 21 are reduced. Specifically, the thicknesses of the base member, the elastic layer, and the separation layer that configure the fixing belt 21 are set within the range of 20-100 μm, 100-300 μm, and 5-50 μm, respectively. Further, the diameter of the fixing belt 21 is set to 20-40 mm. To further reduce the heat capacity, the entire thickness of the fixing belt 21 is preferably set to 0.4 mm or less and more preferably to 0.2 mm or less. Further, the diameter of the fixing belt 21 is preferably set to 30 mm or less. The fixing belt is provided by baking the elastic layer to the base member and coating the separation layer on the elastic layer.

Note that, in the configuration of the embodiment, the diameter of the pressing roller 22 is set to 20-40 mm so that the diameter of the fixing belt 21 becomes the same as that of the pressing roller 22. However, the diameters thereof are not limited to the configuration. For example, the fixing belt 21 may be formed so that the diameter thereof becomes smaller than the diameter of the pressing roller 22. In the case, since the curvature of the fixing belt 21 in the nip portion N becomes larger than the curvature of the pressing roller 22, the recording medium discharged from the nip portion N can be easily separated from the fixing belt 21.

Further, as a result that the diameter of the fixing belt 21 is reduced, a space inside of the fixing belt 21 becomes small. In the embodiment, however, since the stay 25 is formed in a concave shape by being bent on both the end sides and the halogen heater 23 is accommodated inside of the portion formed in the concave shape, the stay 25 and the halogen heater 23 can be disposed even in the small space.

Further, to dispose the stay 25 in a size as large as possible even in the small space, the nip forming member 24 is formed compact on the contrary. Specifically, the nip forming member 24 is formed so that the width thereof in the sheet conveying direction is made smaller than the width of the stay 25 in the sheet conveying direction. Further, in FIG. 2, when the heights of the nip forming member 24 to the respective nip portions N (or virtual extended line E thereof) in an upstream side end portion 24*a* and a downstream side end portion 24*b* in the sheet conveying direction are shown by h1, h2 and a maximum height to the nip portion N (or its virtual extended line E) in the portion of the nip forming member 24 other than the upstream side end portion 24*a* and the downstream side end portion 24*b* is shown by h3, the nip forming member 24 is configured so that $h1 \leq h3$, $h2 \leq h3$ are established. With the configuration, since the upstream side end portion 24*a* and the downstream side end portion 24*b* of the nip forming member 24 do not interpose between the respective bent portions of the stay 25 on an upstream side and a downstream side in the sheet conveying direction and the fixing belt 21, the respective bent portions can be disposed near to the inner peripheral surface of the fixing belt 21. With the configuration, since the stay 25 can be disposed in the limited space in the fixing belt 21 in the size as large as possible, the strength of the stay 25 can be secured. As a result, since the nip forming member 24 can be prevented from being flexed by the pressing roller 22, the fixing property can be improved.

A basic operation of the fixing device according to the embodiment will be explained below. When a power supply switch of the printer main body is turned on, power is supplied to the halogen heater 23, and the pressing roller 22 starts to be driven in rotation clockwise in FIG. 2. With the operation, the fixing belt 21 is rotated counterclockwise in accordance with the rotation of the pressing roller 22 in FIG. 2, by the friction force between the fixing belt 21 and the pressing roller 22.

Thereafter, the sheet P on which an unfixed toner image T is carried by the image forming process described above is conveyed in an arrow A1 direction of FIG. 2 while being guided by a guide plate 37 and fed into the nip portion N in a pressure contact state. Then, the toner image T is fixed onto a surface of the sheet P by the heat generated by the fixing belt 21 heated by the halogen heater 23 and the pressing force between the fixing belt 21 and the pressing roller 22.

The sheet P on which the toner image T is fixed is carried out from the nip portion N in an arrow A2 direction in FIG. 2. At the time, the sheet P is separated from the fixing belt 21 by that the leading end of the sheet P is caused to come into contact with the leading end of the separation member 28. Thereafter, the separated sheet P is discharged to the outside of the apparatus by the discharging roller as described above and stocked on the discharging tray.

Note that, in the printer according to the embodiment, the fixing motor M1 is stopped and the rotation of the fixing belt 21 is stopped, while the sheet P is being transferred by the discharging roller 13 just after the trailing end of the sheet P has been exited from the fixing nip N. In a conventional image forming apparatus, ordinarily, a fixing device and a discharging roller are driven by a common motor, a fixing belt/a fixing roller and a discharging roller are rotated at the same time or stopped at the same time. In contrast, in the example, since the pressing roller 22 and the discharging roller 13 are driven in rotation by the independent motors M1, M2, respectively, the pressing roller 22 can be stopped while the discharging roller 13 is being rotated. Accordingly, it is possible to execute a control for temporarily stopping the fixing motor M1 while the discharging motor M2 is being rotated.

As described above, the drive time of the pressing roller can be reduced by stopping the fixing motor M1 just after the trailing end of the sheet has been exited from the fixing nip N as compared with the conventional apparatus in which the fixing device and the discharging roller are driven/stopped at the same time. Since it is necessary for the fixing motor M1 to drive not only the pressing roller but also the fixing belt, and moreover, the fixing belt receives a resistance by being slid on the nip forming member fixed to the side plate, the fixing motor M1 consumes a large amount of power. Accordingly, as described above, when the fixing motor M1 is temporarily stopped while the discharging motor M2 is being driven after the sheet has been entirely exited from the fixing nip N, the drive time of the fixing motor M1 can be reduced and power can be saved. The temporal stop of the fixing motor M1 can be executed not only when each sheet is fed while plural sheets are continuously fed but also after the plural sheets have been fed.

This advantage can be obtained when it is made possible to independently drive and stop both the pressing roller 22 and the discharging roller 13. Accordingly, the embodiment is not limited to the configuration for driving the discharging roller and the pressing roller by the different motors M1, M2. For example, even if both the rollers are driven by a common motor, the same advantage can be obtained also by using a mechanism in which a clutch is disposed in a torque transmission path from the motor to both the rollers and the rotation and the stop of both the rollers are independently controlled by switching the clutch.

Figure 5:
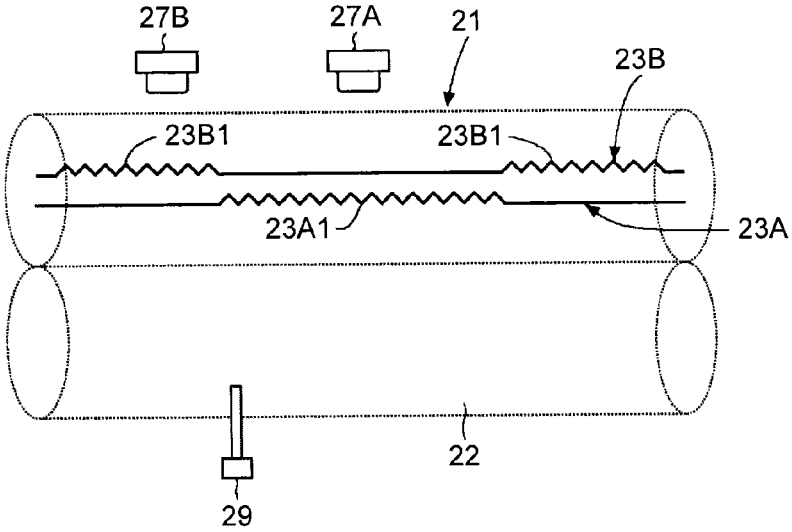
FIG. 5 is a view conceptually illustrating a heat source (halogen heater) and a temperature detecting unit (a thermopile, a thermistor) of a fixing device.

Heating in an axis direction of the fixing belt 21 executed by the two halogen heaters 23A, 23B will be explained below. As can be understood from FIG. 5, the first halogen heater 23A and the second halogen heater 23B have heat-generating portions located at different positions. That is, the first halogen heater 23A has a heat generating portion (light-emitting portion) 23A1 disposed throughout a predetermined range from a central portion in the longitudinal direction thereof. In the embodiment, the heat generating portion 23A1 is disposed in bilateral symmetry from the central portion in the longitudinal direction of the first halogen heater 23A in a range of 200-220 mm. The second halogen heater 23B has heat generating portions (light-emitting portions) 23B1 on both the ends in the longitudinal direction thereof. In the embodiment, the heat generating portions 23B1 are disposed to cover a region up to both the ends of a belt width outside of the region corresponding to the heat generating portion 23A1 of the first halogen heater 23A in the longitudinal direction. Since the sheet passing width of an A3-size sheet and an A4-size sheet in a lateral direction is 297 mm, a total length of the length of the heat generating portion 23A1 of the first halogen heater 23A and the length of the heat generating portions 23B1 of the second halogen heater 23B is set to 300-330 mm so that the total length becomes longer than the sheet passing width. This is because, since an calorific value is reduced in the outside end portions of the heat generating portions 23B1 (a light emitting intensity is reduced) and a temperature drop occurs, it is necessary to use a portion having an calorific value (heat generation intensity) larger than a predetermined calorific value as a sheet feeding region.

In the embodiment, two thermopile 27A and 27B for detecting the temperature of the fixing belt 21 are disposed. These are installed so that the first thermopile 27A corresponds to the heat generating portion 23A1 of the first halogen heater 23A and detects the temperature of the central region of the fixing belt 21, and the second thermopile 27B detects the temperature of the end regions of the fixing belt 21 corresponding to the heat generating portions 23B1 of the second halogen heater 23B.

Figure 6:
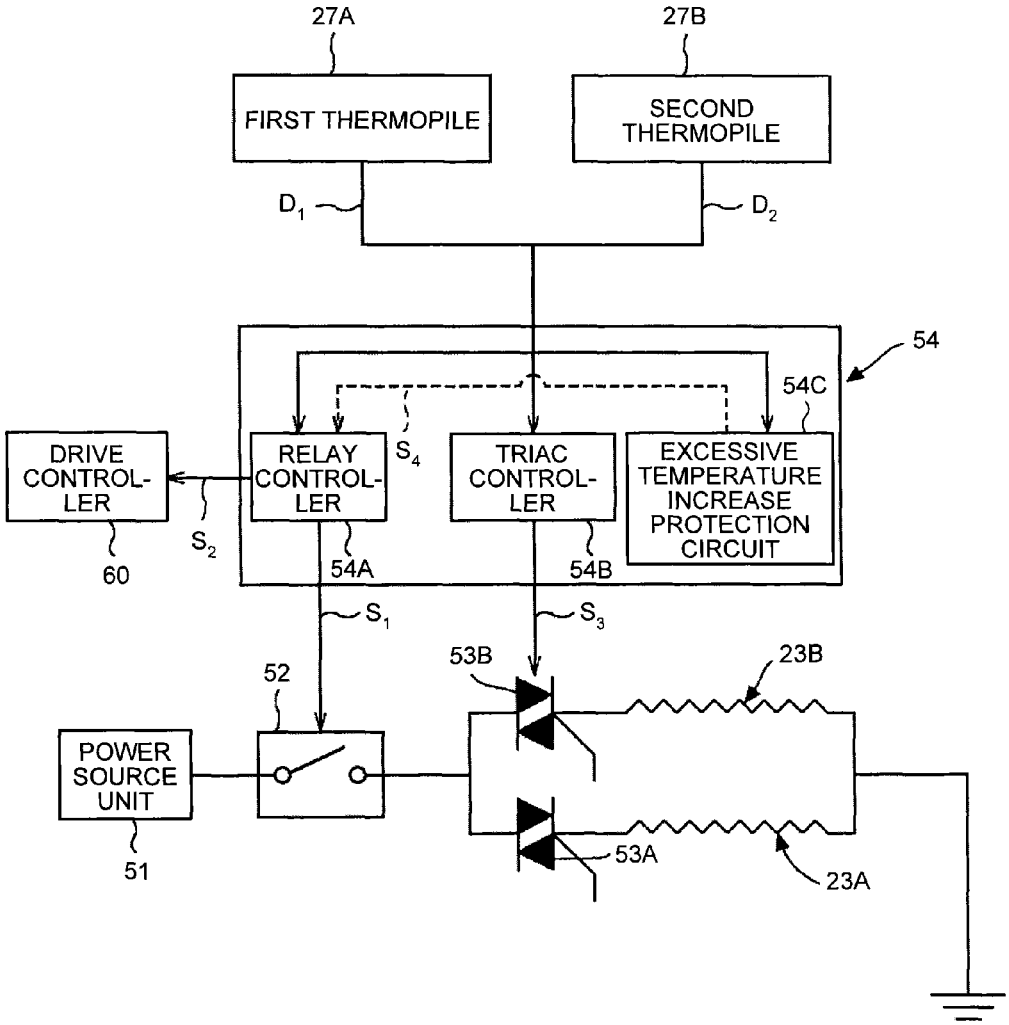
FIG. 6 is a view illustrating a temperature control circuit of a fixing device.

FIG. 6 illustrates a configuration example of a temperature control circuit of the fixing device 20. The power supplied from a power source unit 51 is supplied to the halogen heaters 23A and 23B via a relay 52, triacs 53A and 53B. The relay 52 is turned on (closed) at the time of warming up, execution of a print job, ready/stand-by, and the like but is turned off (opened) at the time other than above cases, i.e., at the time of turning off the power supply, an off-mode, an energy saving mode, a quick stop, and the like. The respective triacs 53A and 53B control the amounts of power supplied to the first halogen heater 23A and the second halogen heater 23B, respectively and feed back the temperature information of the fixing belt 21 detected by the first thermopile 27A and the second thermopile 27B to thereby keep the fixing belt 21 to a predetermined temperature. Note that the ready/stand-by means a state in which print can be started at once at the time a print job instruction is input. That is, software and hardware for operating a machine such as a controller and engine software have been already started and, in the state, although the fixing motor ordinarily stops, the fixing member is kept to a predetermined temperature and the machine can feed a sheet at once.

Further, a temperature controller 54 includes a relay controller 54A for controlling the relay 52; a triac controller 54B for controlling the triacs 53A and 53B; and an excessive temperature increase protection circuit 54C for outputting an abnormal stop signal when the temperature of the fixing belt 21 is excessively increased. To the temperature controller 54, the temperature information of the central region and the end regions of the fixing belt 21 detected by the first thermopile 27A and the second thermopile 27B is input as temperature information values (voltage values) $D_1$ and $D_2$. In the embodiment, the relay controller 54A outputs an ON/OFF control signal $S_1$ to the relay 52 based on the temperature information values $D_1$ and $D_2$ and outputs a drive control signal $S_2$ to a drive controller 60 of the pressing roller 22. The triac controller 54B outputs an energization control signal $S_3$ to the triacs 53A and 53B based on the temperature information values $D_1$ and $D_2$. The excessive temperature increase protection circuit 54C outputs an abnormal stop signal $S_4$ to the relay controller 54A based on the temperature information values $D_1$, $D_2$. However, the embodiment is not limited to that configuration.

Note that, as described already, in the fixing device according to the embodiment, the fixing belt 21 having the reduced heat capacity is directly heated, and moreover, the range in which heat is radiated to the fixing belt 21 is restricted by the reflection member 26. Accordingly, if heating by the halogen heater 23 is continued in a state that the fixing belt 21 is stopped by stopping the drive of the fixing motor M1, there is a possibility that the fixing belt 21 is instantly placed in a state that the temperature thereof has been excessively increased and the belt is damaged. To prevent the disadvantage, when the fixing motor M1 is temporarily stopped, the halogen heater 23 is put out (stopped) before the fixing motor M1 is stopped, whereby the halogen heater 23 is placed in a put-off state at all times when the fixing motor M1 has been stopped. The switching is executed by applying a control signal from the temperature controller 54 to the triac 53. The halogen heater 23 may be put out after the sheet P has perfectly passed through the fixing nip N, or alternatively, may be put out in a state that the trailing end of the sheet P exists in the fixing nip N.

Figure 7A:
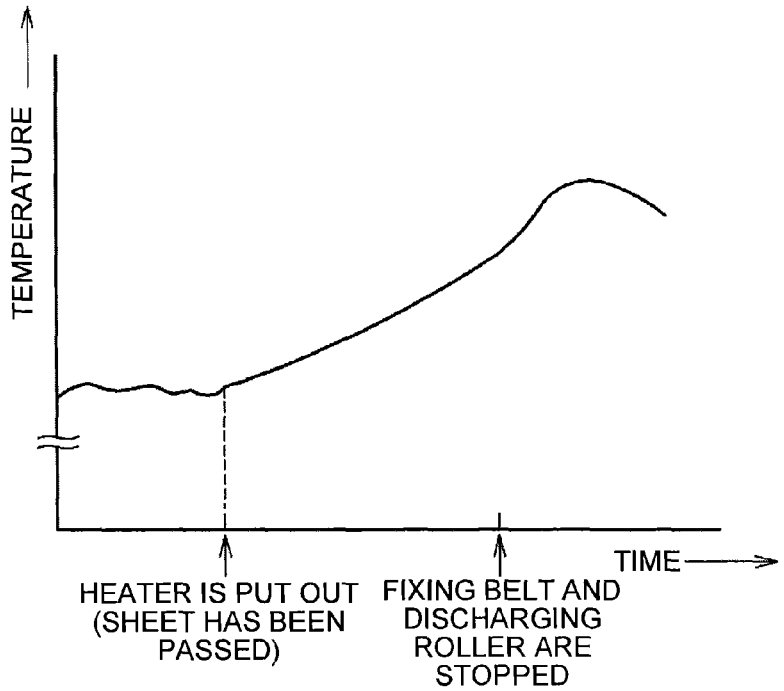
FIG. 7A illustrates a temperature change of a fixing belt when the fixing belt is rotated until a discharging roller is stopped after a heater is put out.
Figure 7B:
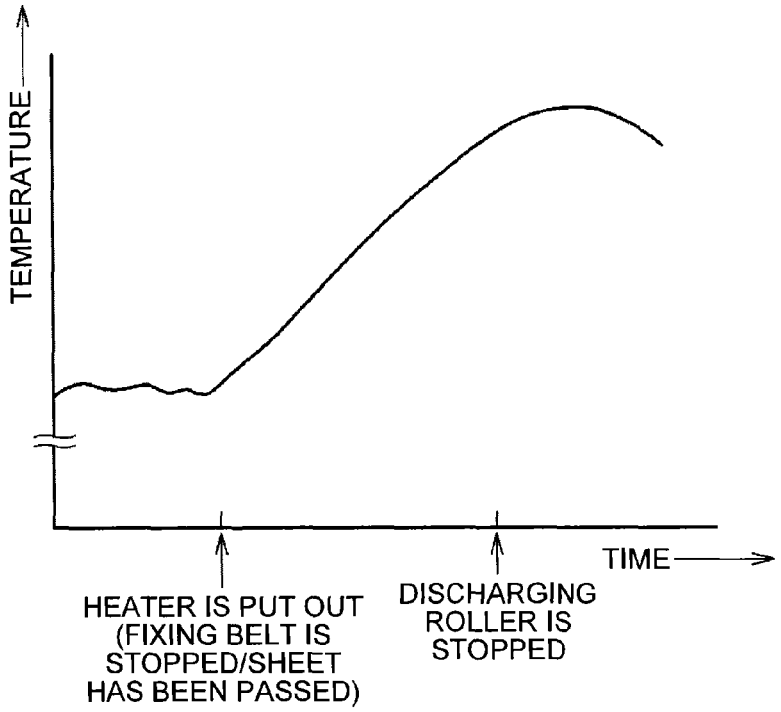
FIG. 7B illustrates a temperature change of the fixing belt when the fixing belt is stopped approximately at the time the heater has been put out.

Meanwhile, the halogen heater 23 is configured such that a heater and halogen are enclosed in a glass tube, and thus, the heat accumulated in the glass tube is radiated even after the heater is put out. Accordingly, in a case when the halogen heater is used as the heat source, the fixing belt 21 is temporarily heated by the remaining heat of the glass tube even after the heater is put out. Further, while the sheet P is passing through the fixing nip N, the sheet P takes heat from the fixing belt 21; however, after the trailing end of the sheet P exits from the fixing nip N (passes through the fixing nip), no heat is released via the sheet P, thereby increasing the temperature of the fixing belt. FIG. 7A illustrates the temperature change of the fixing belt when the fixing belt 21 is rotated until the discharging roller 13 stops after the halogen heater 23 is put out, and FIG. 7B illustrates a temperature change of the fixing belt when the rotation of the fixing belt 21 is stopped at approximately the same timing as that at which the halogen heater 23 is put out. Note that FIGS. 7A and 7B illustrate a case that the sheet has been passed simultaneously with the putting out of the halogen heater as an example.

In a fixing device having a configuration corresponding to FIG. 7A, by performing the rotation of the fixing belt 21, heat is released from the fixing belt 21 even after the heater is put out. Thus, the temperature of the fixing belt 21 is increased gently. In contrast, in a fixing device having a configuration corresponding to FIG. 7B, since the rotation of the fixing belt 21 is stopped simultaneously with the putting out of the heater, no heat is released and the temperature of the fixing belt is abruptly increased. Thus, there is a possibility that the fixing belt is damaged because the temperature of the fixing belt exceeds an upper limit temperature depending on the heat stored therein.

Figure 8:
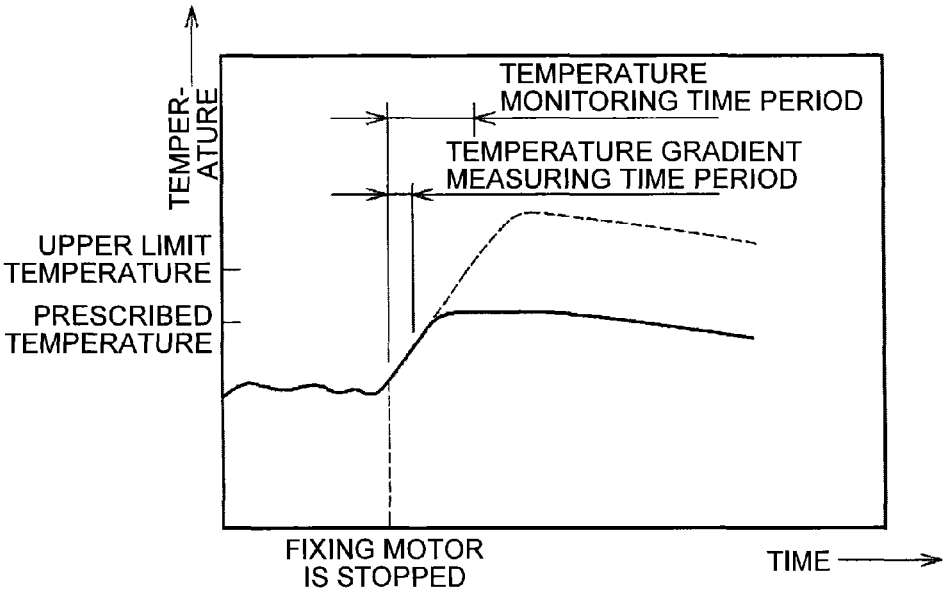
FIG. 8 is a graph illustrating a temperature change of a fixing belt when the belt is rotated as necessary while monitoring the temperature of the fixing belt after a fixing motor has been stopped.

In consideration of the findings described above, the fixing device according to the embodiment is configured such that after the rotation of the fixing belt 21 is stopped, the heat of the fixing belt 21 is released based on the detected value of thermopile 27 as a temperature sensor. The heat release can be performed by, for example, rotating the fixing belt 21 by the fixing motor M1. Specifically, as illustrated in FIG. 8, after the fixing motor M1 is stopped, the temperature controller 54 monitors the temperature of the fixing belt 21 for a predetermined time period, starts the fixing motor M1 at the time the temperature conversion value D of the fixing belt 21 becomes a prescribed temperature or more that is smaller than an upper limit temperature, to rotate the fixing belt 21 and to thereby release heat from the fixing belt 21. With the operation, as illustrated by a solid line in FIG. 8, the temperature of the fixing belt 21 can be prevented from being excessively increased. Note that a broken line in FIG. 8 illustrates temperature change of the fixing belt 21 to be assumed when the fixing belt 21 is stopped simultaneously with the stop of the heater and the stop state of the fixing belt 21 is kept also thereafter.

Figure 9:
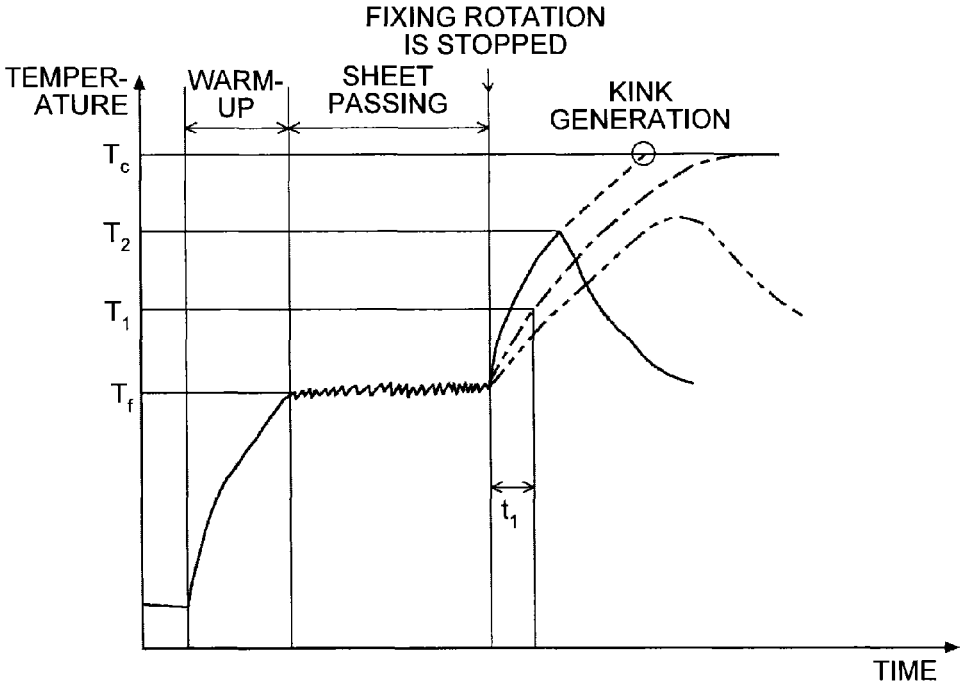
FIG. 9 is a graph illustrating a temperature change of a fixing member.

A more specific operation in the fixing device configured as described above will be explained below. When a fixing process is executed in a condition that heat source and the fixing member store heat such as when sheets are continuously fed (for example, 100 A4Y sheets are continuously fed), the temperature of the fixing belt may be excessively increased by the heat stored in the fixing belt when the rotation of the fixing belt is stopped after the sheets have been passed. FIG. 9 illustrates the temperature transition of the fixing member detected by thermopile in the process from warming-up to sheet-passing and the stop of fixing rotation after the sheet-passing, and further after the process. When the temperature increased in the fixing belt reaches a temperature $T_c$, kink is generated in the fixing belt. To cope with the problem, in an ordinary operation, the rotation of the fixing belt is performed at the time the temperature of the fixing belt reaches a predetermined temperature $T_2$, which is a criterion for preventing the temperature of the fixing belt 21 from being excessively increased and is lower than the kink generation temperature $T_c$. With this, the temperature of the fixing belt is controlled so that the temperature thereof does not increase up to the kink generation temperature $T_c$ by diffusing the heat of the fixing belt to the pressing roller (takeover of heat) while dispersing remaining heat to the whole circumference of the fixing belt. Note that, depending on a sheet feed condition, there may be a case that even if the rotation of the fixing belt is not executed, the temperature thereof does not reach the kink generation temperature $T_c$ and the temperature of the fixing belt is reduced.

As described above, when the temperature of the fixing belt is increased by stopping the fixing rotation after the fixing process as described above, unless the power of the image forming apparatus in its entirety is stopped, heat can be taken from the fixing belt by rotating the fixing belt when this is necessary as a result of detection of a temperature. However, in a case where, from the viewpoint of emphasizing energy saving, an operating state is promptly shifted to a sleep state for stopping the control via the ready/stand-by state and a low power state in a short time of, for example, about one or two seconds after the image forming operation is finished, when the timing at which the temperature of the fixing belt is shifted to the temperature $T_2$ is delayed than the timing at which the operating state is shifted to the sleep state, the fixing belt cannot be rotated in response to the detection of the temperature $T_2$. Therefore, the temperature of the fixing belt reaches the kink generation temperature $T_c$, and kink is generated. To cope with the problem, in this embodiment, as shown in FIG. 9, the temperature controller 54 monitors whether the temperature of the fixing belt reaches up to a predetermined temperature $T_1$ until a relatively short time period $t_1$ has elapsed from the stop of rotation of the fixing motor, by using an elapsed-time counter (not illustrated). The predetermined temperature $T_1$ is a criterion for determining whether the fixing device is to be shifted to sleep mode and is lower than the temperature $T_2$. When the temperature of a surface of the fixing belt is equal to or less than the temperature $T_1$ at the point when the time period $t_1$ has elapsed, the temperature controller 54 allows the fixing device 20 to shift to the sleep state at once. However, when the temperature of the surface of the fixing belt is equal to or more than the temperature $T_1$, the temperature controller prohibits the fixing device from shifting to the sleep state. With the operation, since the fixing belt can be rotated when the temperature thereof has increased up to the temperature $T_2$, the generation of kink can be avoided. The time period $t_1$ is determined based on experiment, simulation, and the like, and is, for example, 5 seconds. Note that although the generation of kink can be avoided by rejecting the shift to the sleep state when the temperature of the surface of the fixing belt is equal to or more than the temperature $T_1$ at the point when the time period $t_1$ has elapsed, a problem arises in the viewpoint of energy saving when the fixing device remains unable to shift to the sleep state. As already described, in the embodiment, the temperature of the fixing belt 21 is monitored for the predetermined time period after the fixing motor M1 is stopped, to thereby perform the heat releasing control. When a condition in which no kink is generated has been continued for a predetermined time, it is preferable to allow the shift to the sleep state.

The temperature $T_1$ is a criterion temperature at which the fixing belt reaches just the kink generation temperature ($T_c$) when the fixing belt does not rotate, and is determined based on experiment or simulation. For example, in the embodiment, 200° C. is selected as the temperature $T_1$. In the embodiment, although the temperature $T_1$ is set to a fixed value, it can be also set using differential value to a temperature ($T_f$) during the sheet-passing or a function. Further, the fixing device is shifted to the sleep mode when the temperature of the surface of the fixing belt is equal to or less than the temperature $T_1$ after the relatively short time period $t_1$ has elapsed from the stop of the rotation of the fixing motor. Therefore, the energy saving can be achieved even in a condition in which no kink is generated. Note that the temperature $T_2$ is, for example, 210° C. and the control temperature $T_f$ during the sheet-passing is, for example, 160° C.

Figure 10:
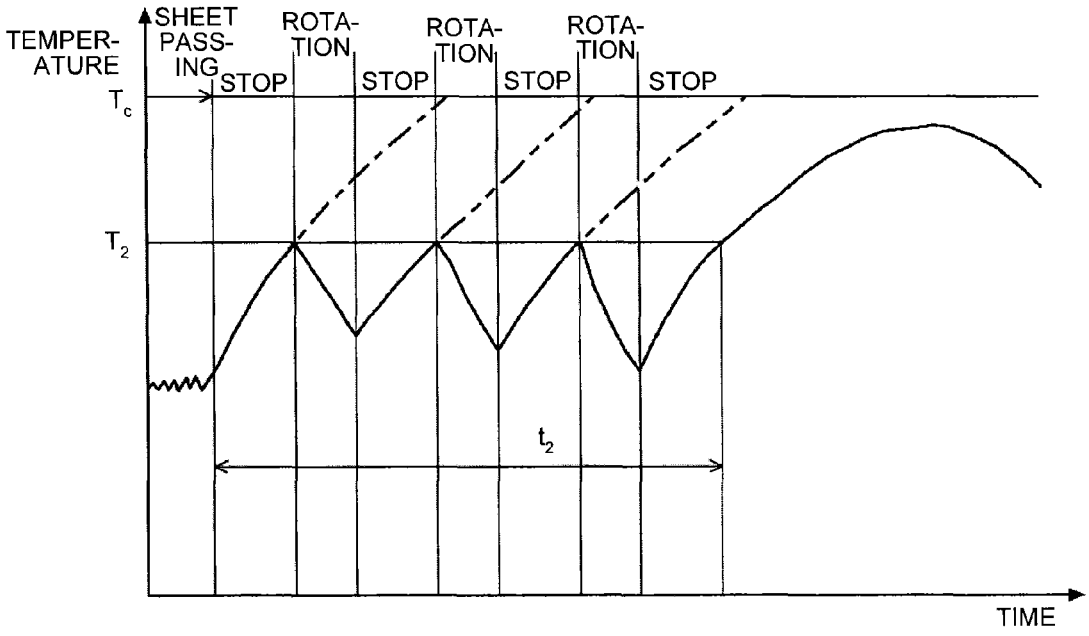
FIG. 10 is a graph illustrating a temperature change of a fixing member.

Further, as illustrated in FIG. 10, when the remaining calorific value of the heat source and the calorific value accumulated in the fixing member are further large (for example, when 1000 sheets is continuously fed), even if heat is dispersed and diffused by rotating the fixing belt after the temperature of the fixing belt reaches the temperature $T_2$ once, a belt temperature may be increased again and reach up to the kink generation temperature $T_c$ after the fixing belt is stopped again because an overshoot is large. Further, even when the fixing belt is rotated again several times repeatedly, the belt temperature may also reach up to the kink generation temperature $T_c$. This problem can be avoided by rejecting the shift to the sleep state during a predetermined time period $t_2$, and keeping a state in which the detection of the temperature of the fixing device and the rotation control are possible. As illustrated in FIG. 10, the predetermined time period $t_2$ is an assumed time period for guaranteeing that the belt temperature does not reach the kink generation temperature $T_c$ even if the fixing device is shifted to the sleep mode after the power supply to the heat source is stopped. The time period $t_2$ is determined based on experiment, simulation, and the like. In the embodiment, the time period $t_2$ is set to 60 seconds. Alternatively, it may be set to 300 seconds.

Figure 11:
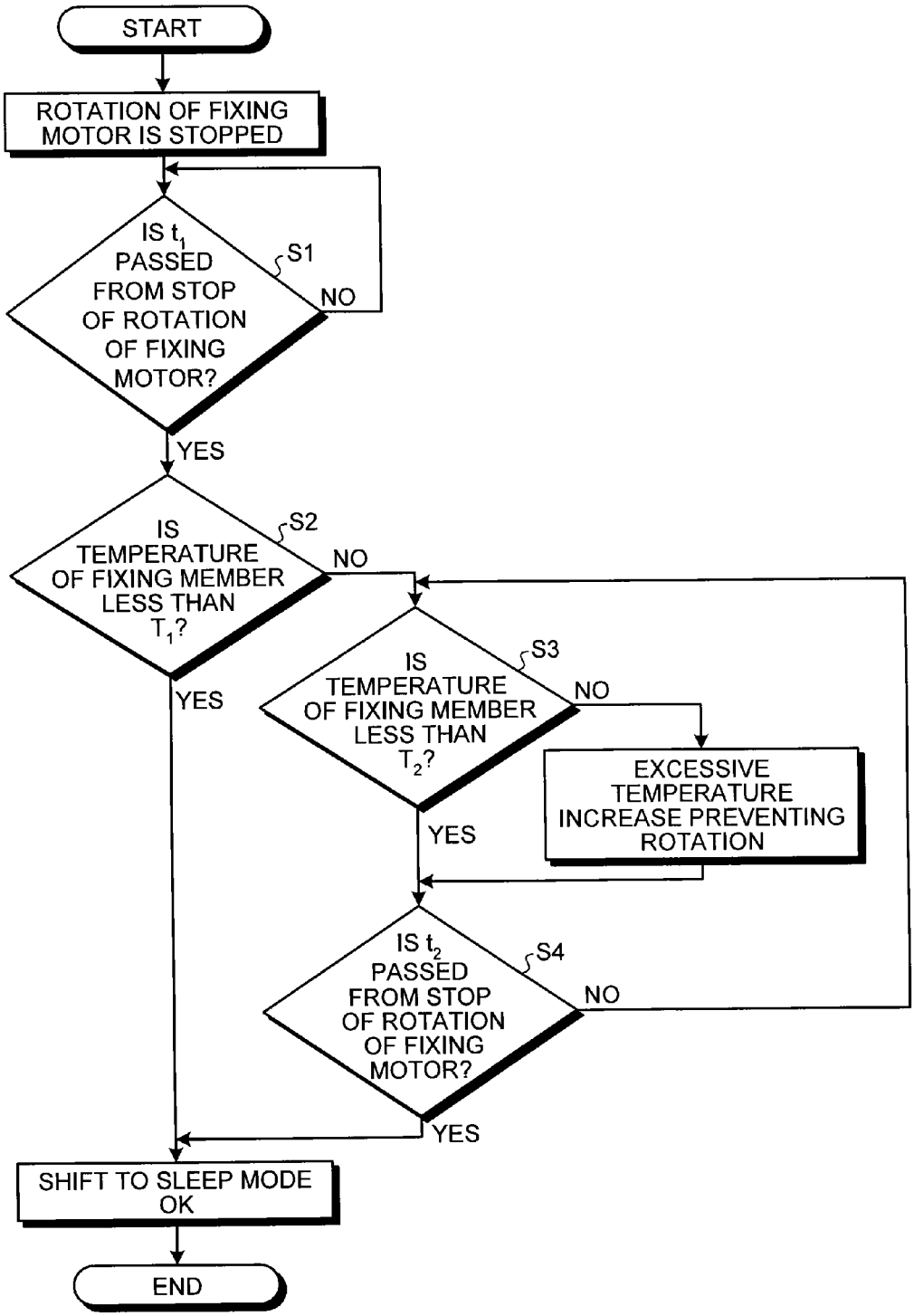
FIG. 11 is a flowchart for prohibiting a shift to a sleep mode.

A flowchart for prohibiting the fixing device from shifting to a sleep mode is illustrated in FIG. 11. Whether or not the belt temperature reaches the temperature $T_1$ is determined (S2) at the point when the time period $t_1$ has passed (S1) from the rotation of the fixing motor M1 is stopped. When the temperature of the surface of the fixing belt is less than the temperature $T_1$ at the point when the time period $t_1$ has passed, the shift to the sleep state is allowed at once. When the temperature of the surface of the fixing belt is equal to or more than $T_1$, the shift to the sleep state is rejected for the time period $t_2$. Then, when the temperature of the surface of the fixing belt is equal to or more than the temperature $T_2$ (S3), the fixing belt is rotated to prevent an excessive temperature increase. During the time period $t_2$, whether or not the temperature of the surface of the fixing belt is less than the temperature $T_2$ is repeatedly determined, and after the time period $t_2$ has passed (S4), the shift to the sleep state is allowed.

Additionally, in the following cases, the shift to the sleep state may be allowed without waiting that the time period $t_1$ has passed.

1) When the number of sheets to be continuously printed is small:

2) When a fixing temperature is set relatively low at the time when a thin sheet is fed (for example, when a monochromatic sheet having a small deposit amount is fed): and 3) When a sheet is fed just after power-on for returning from the sleep state.

However, those cases are only exemplification and the shift to the sleep state is not always allowed at once to all of the cases. When there is the slightest possibility that the rotation for preventing an excessive temperature increase is necessary, it is necessary to prohibit the fixing device from shifting to the sleep state.

The invention can be also applied to a fixing device employing other system, for example, a fixing device employing a belt system in which a fixing belt is stretched between a fixing roller and a heating roller and the pressing roller is caused to come into pressure contact with the fixing roller via the fixing belt, and the like. When the fixing belt is stretched by the fixing roller and the heating roller, the heating roller may be driven. Further, the fixing device according to the invention can be mounted on not only the color laser printer illustrated in FIG. 1 but also on a monochromatic image forming apparatus and other electrophotographic image forming apparatus.

According to the invention, since whether or not a shift to sleep is executed is determined in a short time from the completion of an image fixing operation by rejecting the shift to a sleep state when a temperature of the range of a fixing member confronting a heat source is equal to or more than a predetermined temperature $T_1$ in a predetermined time $t_1$ from the stop of rotation of a fixing device, not only kink can be avoided from being generated by local thermal expansion of the fixing member by securing an excessive temperature increase prevention operation but also energy saving can be achieved by executing the shift to sleep instantly in a temperature condition in which no kink is generated.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing device capable of shifting to a sleep state, the fixing device comprising:

a heat source;

a rotatable fixing member that is heated by the heat source to heat an unfixed image carrying surface of a recording medium;

a rotatable pressing member that is in pressure contact with the fixing member to form a nip portion between the pressing member and the fixing member;

a rotation drive unit that directly or indirectly rotates the fixing member or the pressing member;

a temperature detecting unit that detects a temperature of the fixing member; and a controller configured to:

prohibit the fixing device from shifting to the sleep state when the temperature of the fixing member is equal to or more than a predetermined temperature $T_1$ at a point after a stop of rotation drive of the rotation drive unit, and allow the fixing device to shift to the sleep state in a predetermined sheet feed condition that is employed before the stop of rotation drive of the rotation drive unit, without determining whether to prohibit the fixing device from shifting to the sleep state.

2. The fixing device according to claim 1, wherein the predetermined sheet feed condition is that the number of sheets to be continuously printed is small.

3. The fixing device according to claim 1, wherein the predetermined sheet feed condition is that a fixing temperature is set low.

4. The fixing device according to claim 1, wherein the predetermined sheet feed condition is that a recording sheet is fed just after power-on for returning from the sleep state.

5. An image forming apparatus comprising the fixing device according to claim 1.

6. A method for shifting a fixing device to a sleep state, comprising:

heating a rotatable fixing structure by a heater to heat an unfixed image carrying surface of a recording medium, a rotatable pressing structure being in pressure contact with the fixing structure to form a nip portion between the pressing structure and the fixing structure, and a rotation drive mechanism directly or indirectly rotates the fixing structure or the pressing structure;

detecting a temperature of the fixing structure with a temperature detector;

prohibiting the fixing device from shifting to the sleep state when the temperature of the fixing structure is equal to or more than a predetermined temperature $T_1$ at a point after a stop of rotation drive of the rotation drive mechanism; and allowing the fixing device to shift to the sleep state in a predetermined sheet feed condition that is employed before the stop of rotation drive of the rotation drive mechanism, without determining whether to prohibit the fixing device from shifting to the sleep state.

7. The method according to claim 6, wherein the predetermined sheet feed condition is that the number of sheets to be continuously printed is small.

8. The method according to claim 6, wherein the predetermined sheet feed condition is that a fixing temperature is set low.

9. The method according to claim 6, wherein the predetermined sheet feed condition is that a recording sheet is fed just after power-on for returning from the sleep state.

10. A fixing device capable of shifting to a sleep sate, the fixing device comprising:

a heater;

a rotatable fixing structure that is heated by the heater to heat an unfixed image carrying surface of a recording medium;

a rotatable pressing structure that is in pressure contact with the fixing structure to form a nip portion between the pressing structure and the fixing structure;

a rotation drive mechanism that directly or indirectly rotates the fixing structure or the pressing structure;

a temperature detector that detects a temperature of the fixing structure; and circuitry configured to:

prohibit the fixing device from shifting to the sleep state when the temperature of the fixing structure is equal to or more than a predetermined temperature $T_1$ at a point after a stop of rotation drive of the rotation drive mechanism, and allow the fixing device to shift to the sleep state in a predetermined sheet feed condition that is employed before the stop of rotation drive of the rotation drive mechanism, without determining whether to prohibit the fixing device from shifting to the sleep state.

11. The fixing device according to claim 10, wherein the predetermined sheet feed condition is that the number of sheets to be continuously printed is small.

12. The fixing device according to claim 10, wherein the predetermined sheet feed condition is that a fixing temperature is set low.

13. The fixing device according to claim 10, wherein the predetermined sheet feed condition is that a recording sheet is fed just after power-on for returning from the sleep state.

14. An image forming apparatus comprising the fixing device according to claim 10.

* * * * *